US005537743A

United States Patent [19]

Hibino et al.

[11] Patent Number: 5,537,743

[45] Date of Patent: Jul. 23, 1996

[54] METHOD OF LINKING PISTON ROD WITH OTHER PARTS IN COMPRESSOR

[75] Inventors: Sokichi Hibino; Eiji Tokunaga; Akihiro Amano; Takahiro Hamaoka, all of Kariya, Japan

[73] Assignee: Kabushiki Kaisha Toyoda Jidoshokki Seisakusho, Kariya, Japan

[21] Appl. No.: 259,665

[22] Filed: Jun. 14, 1994

[30] Foreign Application Priority Data

Jun. 14, 1993 [JP] Japan ..... 5-142356

[51] Int. Cl.[6] ..... B23P 15/00

[52] U.S. Cl. ..... 29/888.02; 29/505

[58] Field of Search ..... 29/888.02, 505, 29/898.045

[56] References Cited

U.S. PATENT DOCUMENTS

| | | | |
|---|---|---|---|
| 3,473,444 | 10/1969 | Leffers | 92/176 |
| 4,368,931 | 1/1983 | Cash et al. | 29/898.045 |
| 4,550,645 | 11/1985 | Beck, Jr. | 29/888.02 |
| 4,620,475 | 11/1986 | Watts | 29/888.02 |
| 4,747,203 | 5/1988 | Yukita et al. | 29/898.045 |
| 5,101,555 | 4/1992 | Hauser | 29/888.02 |

FOREIGN PATENT DOCUMENTS

| | | | |
|---|---|---|---|
| 0089739 | 9/1983 | European Pat. Off. | 29/888.02 |
| 1530236 | 6/1968 | France . | |
| 1299531 | 7/1969 | Germany . | |
| 004034766 | 5/1992 | Germany | 29/888.02 |
| 3406782C2 | 9/1992 | Germany | F04B 1/00 |
| 0013430 | 1/1983 | Japan | 29/898.045 |
| 5-20593 | 3/1993 | Japan . | |
| 819114 | 8/1959 | United Kingdom . | |
| 1068078 | 5/1967 | United Kingdom . | |

*Primary Examiner*—Irene Cuda
*Attorney, Agent, or Firm*—Hickman Beyer & Weaver

[57] ABSTRACT

Disclosed is a method for connecting a piston with a disk plate by way of a piston rod in a compressor. The disk plate is rotatably mounted on a drive shaft for the integral rotation with the shaft for driving a piston. The piston rod is mechanically connected to the disk plate and the piston at its both end. After forming spherical portions at both ends of the piston rod, cavities are formed in the in the disk plate and the piston in conformity with the spherical portions. Subsequently, a cylindrical wall protruding from an opening edge of each cavity is formed. The cylindrical wall is then caulked inwardly in such a manner that an annular clearance having a wedge-like cross section is defined between an inner circumference of the free end and an outer circumference of the spherical portion which is accommodated in the cavity.

18 Claims, 6 Drawing Sheets

METHOD OF LINKING PISTON ROD WITH OTHER PARTS IN COMPRESSOR

BACKGROUND OF THE INVENTION

1. Field of the Invention

The present invention relates to a method of linking a piston rod to various compressor components.

2. Description of the Related Art

In general, wobble type compressors compress gas by converting the wobbling motion of a swash plate into the reciprocal motion of a piston inside a cylinder. The usual wobble type compressor thus utilizes a rotating drive shaft to support a swash plate that wobble as the drive shaft revolves. The piston is linked to the swash plate via a piston rod, and the piston performs a reciprocating operation as the swash plate wobbles.

In order to convert the wobbling movement of the swash plate into a reciprocating operation of the piston, the piston rod must be linked to the swash plate and piston in such a way that permits the oscillatory movement of the swash plate, piston rod and piston. Accordingly, as shown in FIG. 7, a piston rod 12 is provided with balls 120 and 121 integrally formed at each end of the piston rod. A cavity 13, defined in the swash plate 10, has a shape that conforms to that of the ball 120. Another cavity 14, having a shape conforming to that of the ball 121, is defined in a piston 11.

The cavities 13 and 14 receive and supports the balls 120 and 121, respectively, in such a way that the balls 120 and 121 are slidable along the inner wall surface of the cavities 13 and 14. A pair of cylindrical walls 21 extend from the opening edges of the cavities 13 and 14 and are caulked at portions defined by the circumferences of the balls 120 and 121. This permits the balls 120 and 121 to be slidably retained along the inner wall surfaces of cavities 13 and 14. The balls 120 and 121, thus secured in the cavities 13 and 14 link the swash plate 10, piston 11 and piston rod 12 together and permit their oscillatory movement.

The assembly of the ball 120 and swash plate 10 requires that the ball 120 be fitted or incorporated to the swash plate 10. This is commonly done by first providing a cylindrical wall 21 which has a uniform thickness formed along the opening edge of the cavity 13, as shown in FIG. 8. A punch 20 having a bowl surface 200 is then pressed against the cylindrical wall 21 to plastically deform the cylindrical wall 21 along the circumference of the ball 120 placed in the cavity 13, as shown in FIGS. 8 and 9. The ball 120 is in this way made an integral component with the swash plate 10. The same process is used to link or integrate the piston rod 12 with the piston 11. After incorporation of the piston rod 12 into the swash plate 10 and piston 11, the punch 20 is then split at the parting line 201 and retracted from it's previous position.

Should the height of the cylindrical wall 21 be increased in order to enhance the wall's strength, the area of contact between the inner circumferential surface of the cylindrical wall 21 and the ball 120 or (121) would likewise increase. Increasing this area of contact, however, inhibits the smooth oscillation of the rod 12 with the balls 120, 121. It follows from this that increasing the height of cylindrical wall 21, promotes energy loss and a decrease to the overall operational efficiency of compressor.

In addition, utilizing a large area of contact between the cylindrical wall 121 and ball 120 prevents adequate lubrication from being supplied to the contact area. This makes burning likely to occur between the cylinder wall 21 and ball 120. A further disadvantage of increasing the height of the cylindrical wall 21, is the manufacturing difficulties presented in linking the piston rod 12 to ball 120 etc. By increasing the height of the cylindrical wall 21, a greater plastic deformation is required during the assembly and linkage of the cylindrical wall 21 to the ball 120. This tends to lower the durability of the cylindrical wall 21 by increasing the concentration of internal stresses at the cylindrical wall's root.

SUMMARY OF THE INVENTION

Accordingly, it is a primary objective of the present invention to increase the strength of the assembly linking the piston, piston rod and balls.

It is another objective of the invention to further improve and facilitate the oscillating movement of the piston rod and to prevent any occurrence of the piston rod baking.

It is a further objective of the invention to moderate the concentration of the internal stresses at the roots of the cylindrical walls so as to improve their durability.

BRIEF DESCRIPTION OF THE DRAWINGS

The features of this invention that are believed to be novel are set forth with particularity in the appended claims. The invention, together with the objects and advantages thereof, may best be understood by reference to the following description of the presently preferred embodiments taken in conjunction with the accompanying drawings in which:

FIG. 1 is a cross-sectional view of a wobble type compressor;

FIG. 2 shows in cross-sectional view the process of incorporating the piston rod with the swash plate;

FIG. 3 shows in cross-sectional view where the piston rod is fully incorporated with the swash plate; and FIG. 4 is a partially enlarged cross-sectional view of the linking section.

FIG. 7 shows how the piston rod is linked with the swash plate and the piston according to the prior art;

FIG. 8 is a cross-sectional view illustrating the process of incorporating the piston rod with the swash plate; and FIG. 9 is a cross-sectional view illustrating the piston rod is fully incorporated with the swash plate.

DETAILED DESCRIPTION OF THE PREFERRED EMBODIMENTS

Figure 1:
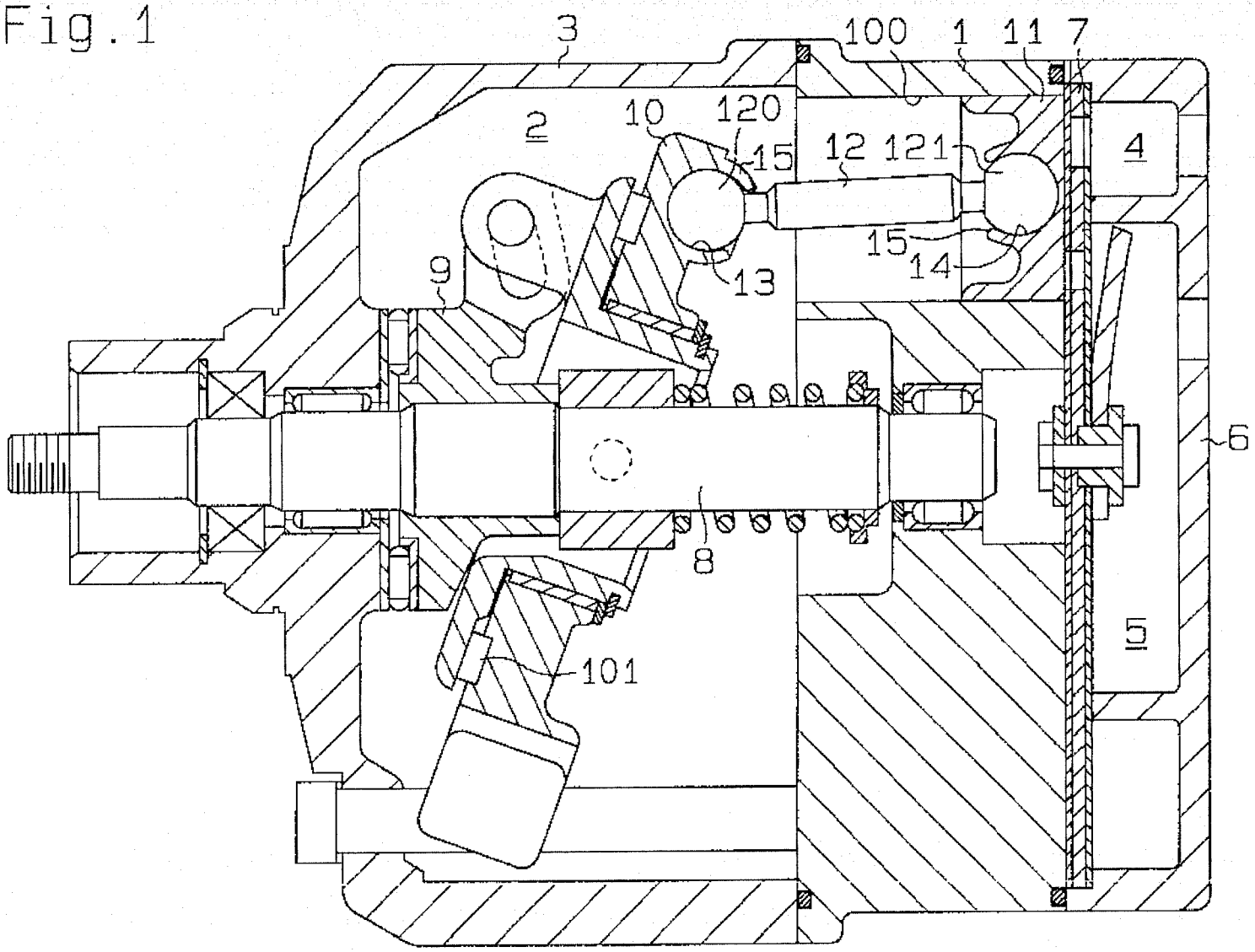
FIGS. 1 to 4 illustrate an embodiment of the invention.

As illustrated in the drawings, one embodiment of the invention will now be described referring to FIGS. 1 to 4.

FIG. 1 is a cross-sectional view of a wobble type compressor of the present invention. As shown in FIG. 1, a front housing 3 is secured to a cylinder block 1, with a crank chamber 2 defined therein. A rear housing 6 is secured to the cylinder block 1 via a valve plate 7. An inlet chamber 4 and a discharge chamber 5 are defined in the rear housing 6. Together, the cylinder block 1, front housing 3 and rear housing 6 constitute a compressor housing.

A drive shaft 8, rotatably supported between the cylinder block 1 and the front housing 3, has a rotor 9 attached to it at the front housing portion of the compressor housing. A swash plate 10 is fitted on the rotor 9 via a plurality of rollers 101 etc. It is to be noted that the swash plate can be replaced by another disk plate, such as a wave plate. A plurality of cylinder bores 100 are defined in the cylinder block 1. A piston 11 is accommodated in each cylinder bore 100, and is linked to the swash plate 10 via a piston rod 12.

Although the rotation of drive shaft 8 causes the rotor 9 to rotate, this rotation will not cause swash plate 10 to rotate; rather, swash plate 10 makes a wobbling movement with respect to drive shaft 8. The result of this is to cause the piston 11 to reciprocate within it's cylinder bore 100.

Figure 2:
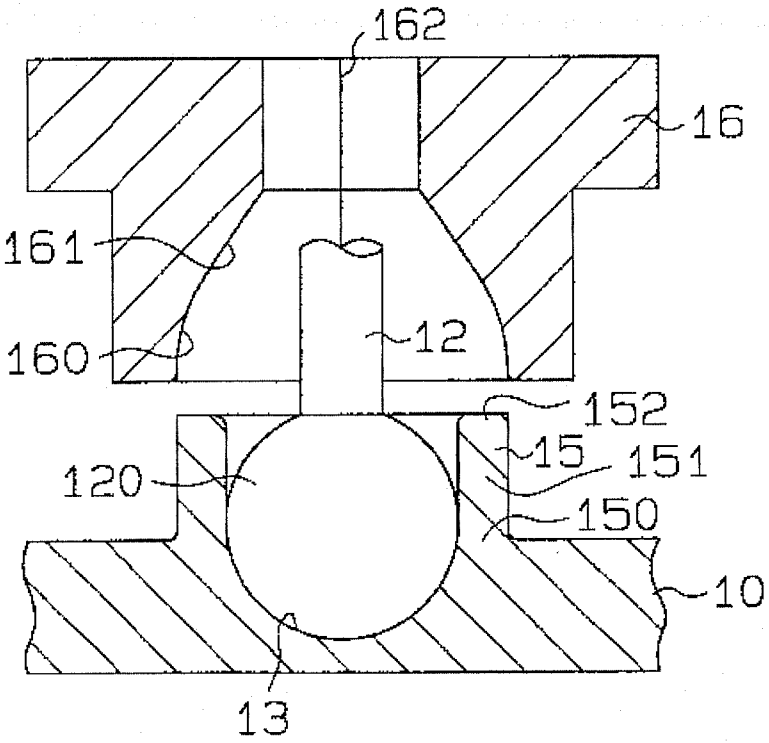
Figure 3:
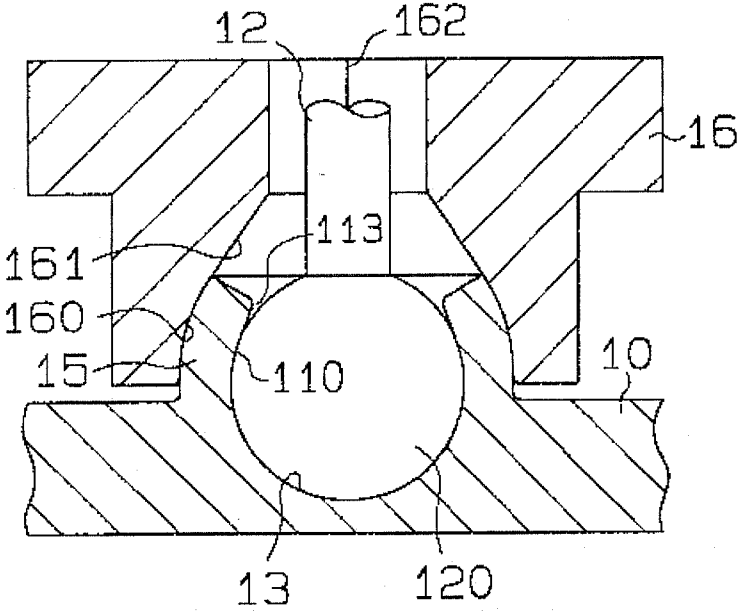
Figure 4:
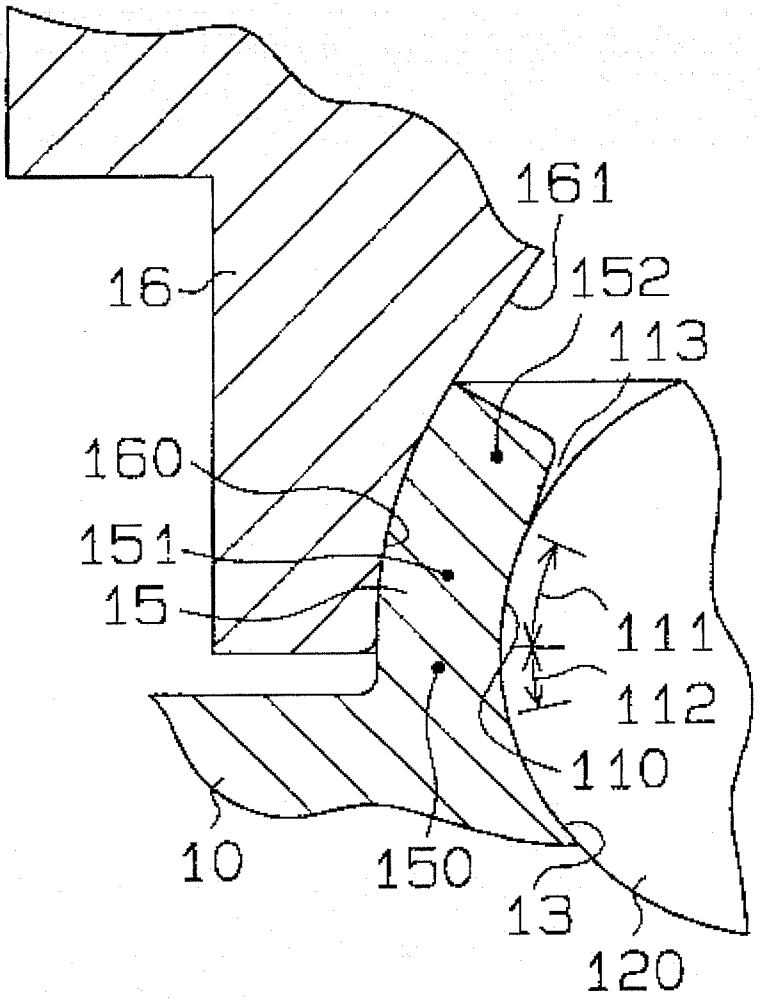

The piston rod 12 has balls 120 and 121 integrally formed at each end. A cavity 13, having a shape conforming to that of the ball 120, is defined in the swash plate 10. Another cavity 14, having a shape conforming to that of the ball 121, is defined in the piston 11. The balls 120 and 121 of the piston rod 12 are accommodated in the cavities 13 and 14 in such a way that they can slide along the inner wall surfaces of cavities 13 and 14 respectively. A cylindrical wall 15 is formed to protrude from the opening edge of each cavity 13, 14. As shown in FIGS. 2 to 4, the cylindrical wall 15 has a uniform thickness from the root 150 to the free end 152 thereof. The balls 120 and 121 retained in the cavities 13 and 14, are slidable along the inner wall surfaces thereof due to the caulking of the cylindrical wall 15.

In the following description, incorporation of the piston rod 12 with the swash plate 10 is described, and incorporation of the piston rod 12 with the piston 11 will be omitted, since their incorporation is similar to that of rod 12 and swash plate 10.

As shown in FIGS. 2 to 4, a punch 16 is used when the swash plate 10 is linked with the piston rod 12. The punch 16 has a bowl surface 160 having an arcuate cross section. A tapered surface 161, is both contiguous to and located on a tangential line of the bowl surface 160. The punch 16 can be split at a parting line 162.

When the ball 120 of the piston rod 12 is incorporated with the swash plate 10 using the punch 16, the ball 120 is first placed in the cavity 13 of the swash plate 10. Next, the punch 16 is moved in the axial direction of the piston rod 12 to be thrust against the cylindrical wall 15. Then, as shown in FIGS. 3 and 4, the cylindrical wall 15 is caulked from the root 150 to the middle portion 151 thereof by the bowl surface 160 of the punch 16. Further, the free end 152 of the cylindrical wall 15 is caulked by the tapered surface 161 of the punch 16.

As a result, the cylindrical wall 15 is brought into contact with the ball over a surface range substantially tangent to a location at the root 150 to the middle portion 151. A contact surface 110 having an arcuate cross section is formed along the inner circumference of the cylindrical wall 15 from the root 150 substantially to the middle portion 151 thereof. Further, an annular clearance 113 having a wedge-like cross section is defined between the inner circumference at the free end 152 of the cylindrical wall 15 and the outer circumference of the ball 120.

The range over which the contact surface 110 is formed by the linkage assembly or incorporating operation actually corresponds only to the middle portion 151 of the cylindrical wall 15, as indicated by the range 111 in FIG. 4. In the lower range 112, lower than the range 111, i.e. the portion corresponding substantially to the root 150 of the cylindrical wall 15, the inner diameter of the cavity 13, that of the cylindrical wall 15 and the diameter of the ball 120, are designed to have sizes so as to form a very small clearance between the cylindrical wall 15 and the ball 120. Consequently, the ball 120 will not press too strongly against the inner circumference of the cylindrical wall 15 at the root 150. When the piston rod 12 is linked to the swash plate 10. This effectively moderates the concentration of the internal stress at the root 150.

The swash plate 10 is linked with the piston rod 12 by allowing the cylindrical wall 15 to undergo plastic deformation to be incorporated with the ball 120. The punch 16 is then split at the parting line 162 to retract from the operation position. This incorporating operation described above is carried out with the piston 11 or the swash plate 10 being placed on a table (not shown).

According to the present embodiment, the cylindrical wall 15 is formed to have a uniform thickness along the axis thereof. The tapered surface 161 of the punch 16 is formed to be both contiguous tangent to the bowl surface 160. After the caulking of the cylindrical wall 15 with the punch 16, a clearance 113 having a wedge-like cross section is defined between the inner circumference at the free end 152 of the cylindrical wall 15 and the outer circumference of the ball 120. This prevents the inner circumference at the free end 152 of the cylindrical wall 15 from being brought into contact with the ball 120.

Even if the height of the cylindrical wall 15 is increased in order to enhance its strength, the area of contact between the cylindrical wall 15 and the ball 120 will not increase. Consequently, the friction between the cylindrical wall 15 and the ball 120 can be reduced in order to facilitate the smooth oscillating movement of the piston rod 12 under operation of the compressor. This contributes to prevent baking of the cylindrical wall 15 and the ball 120.

An annular clearance 113 is defined between the inner circumference at the free end 152 of the cylindrical wall 15 and the outer circumference of the ball 120. The cylindrical wall 15 therefore undergoes less plastic deformation. This in turn moderates the concentration of the internal stresses formed at the root 150, and improves the durability of the cylindrical wall 15.

Since the clearance 113 has a wedge-like cross section, a refrigerant gas containing suspended lubricating oil can be supplied through the clearance 113 to the contact surface 110 under operation of the compressor, improving lubricity of the contact section.

Although only one embodiment of the present invention has been described herein, it should be apparent to those skilled in the art that the present invention may be embodied in many other specific forms without departing from the spirit or scope of the invention. Particularly, it should be understood that the following modes are to be applied.

Figure 5:
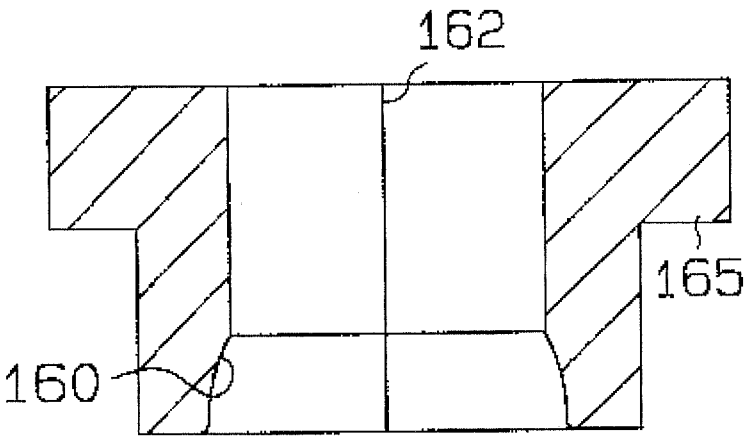
FIG. 5 is a cross sectional view illustrating a first punch having a bowl surface according to a second embodiment.
Figure 6:
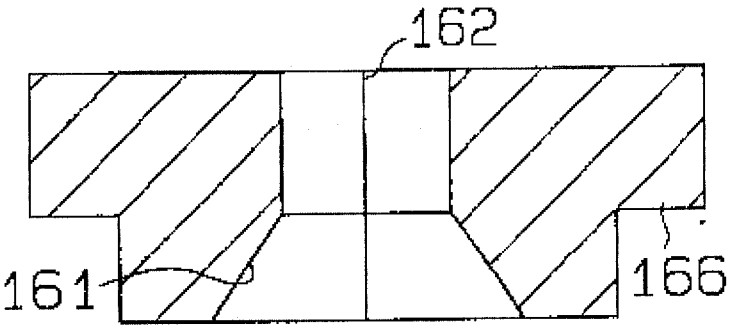
FIG. 6 is a cross sectional view a second punch having a tapered surface according to the second embodiment.
Figure 7:
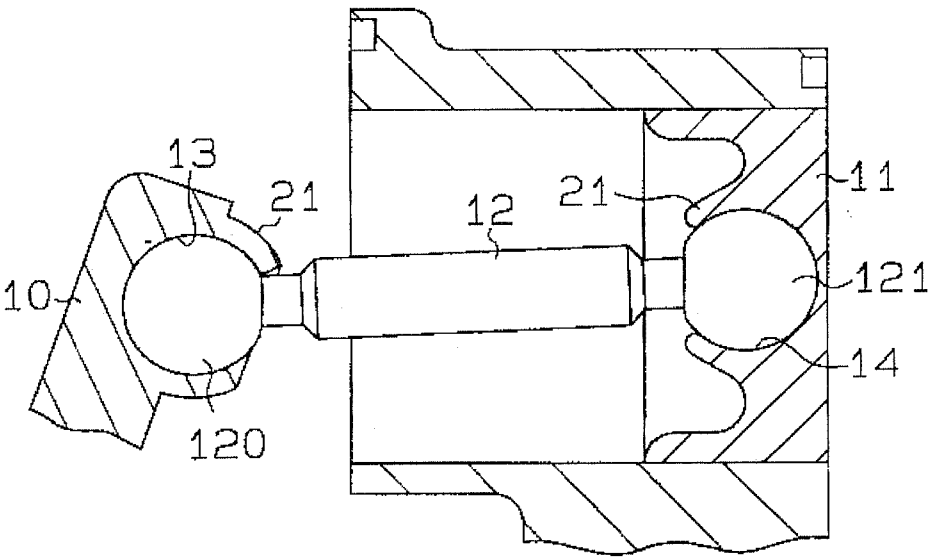
Fig. 7 (Prior Art)
FIGS. 7 to 9 illustrate a prior art embodiment.
Figure 8:
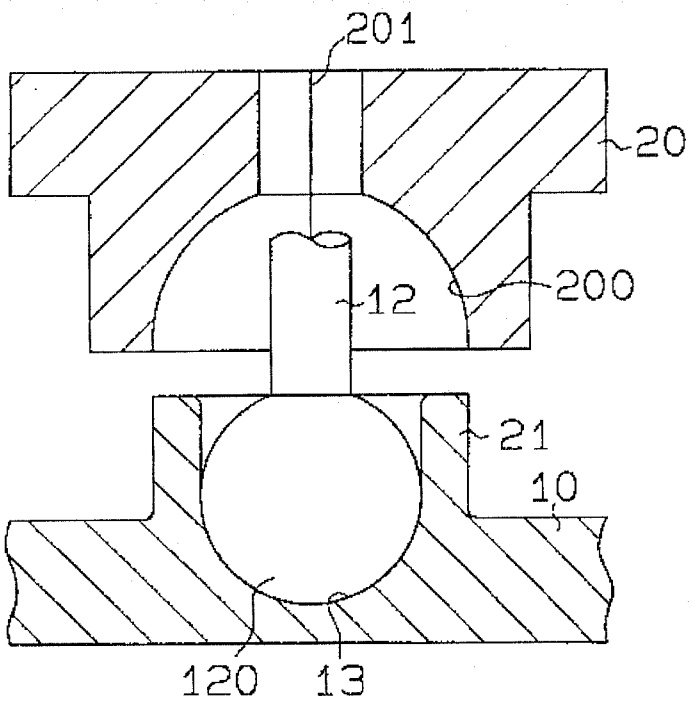
Fig. 8 (Prior Art)
Figure 9:
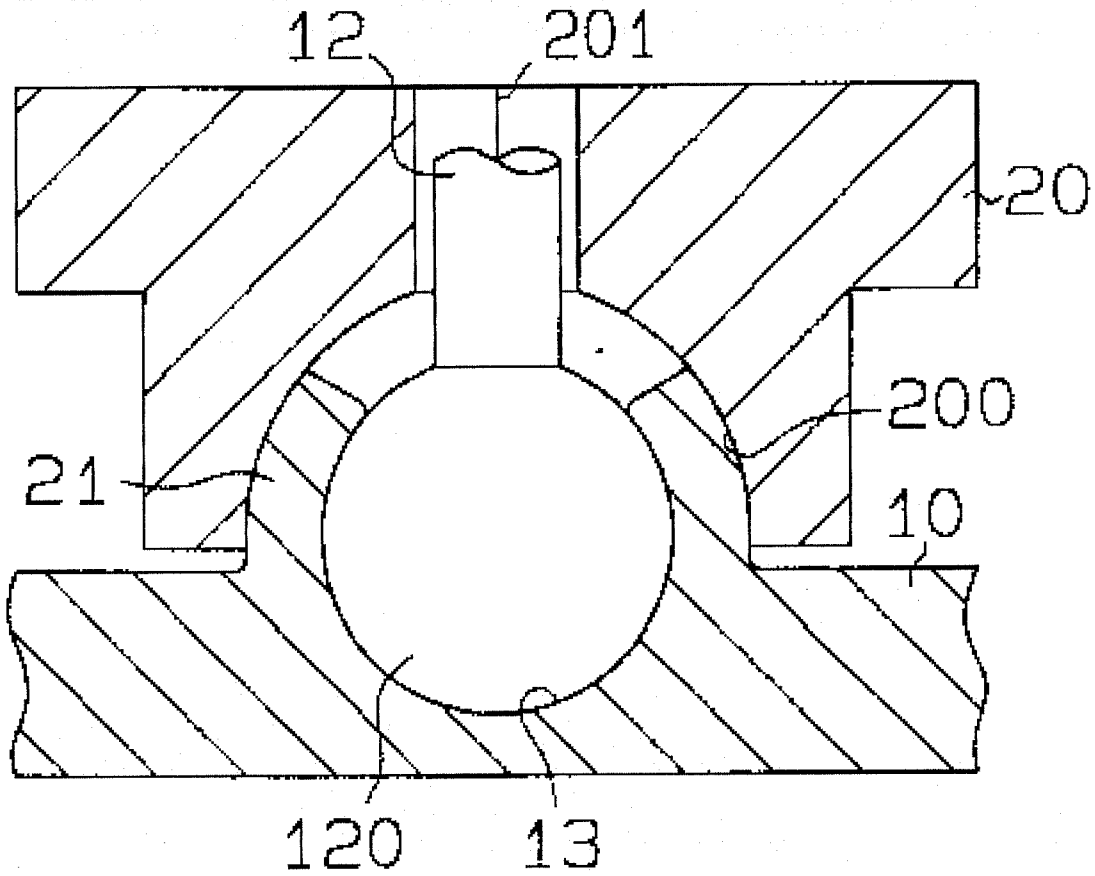
Fig. 9 (Prior Art)

(1) While the bowl surface 160 and the tapered surface 161 are formed in one punch 16 in the above embodiment, a first punch 165 having a single bowl surface 160 and a second punch 166 having a single tapered surface 161 may be used to carry out two-step caulking operation using the two punches 165, 166, as shown in FIGS. 5 and 6.

(2) While the tapered surface 161 is formed substantially tangent to the bowl surface 160 in the above embodiment, the tapered surface 161 may be formed slightly apart from a line tangent to the bowl surface 160 so as to secure a wider clearance 113 between the free end 152 of the cylindrical wall 15 and the ball 120.

Therefore, the present examples and embodiment are to be considered as illustrative and not restrictive and the invention is not to be limited to the details given herein, but may be modified within the scope of the appended claims.

What is claimed is:

1. A method for linking a piston rod with a piston in a compressor having a disk plate operatively driven by a rotor rotatably mounted on a drive shaft for integral rotation therewith, the piston rod being mechanically connected to the disk plate and the piston at opposite ends of the piston rod such that the piston is reciprocally driven in accordance with the rotation of the rotor, said method comprising:

a first process for forming a spherical portion at one end of the piston rod;

a second process for forming a cavity in the piston in conformity with the spherical portion of the piston rod;

a third process for forming a cylindrical wall protruding from an opening edge of the cavity, said cylindrical wall having a root and a free end; and a fourth process for caulking the cylindrical wall inwardly for defining an annular clearance having a wedge-like cross section between an inner circumference of the free end of the cylindrical wall and an outer circumference of the spherical portion of the piston rod accommodated in the cavity.

2. A method as set forth in claim 1, wherein said cylindrical wall has a uniform thickness from the root to the free end.

3. A method as set forth in claim 1, wherein the cylindrical wall is caulked by a punch having a bowllike surface for caulking a range between the root and a middle portion of the cylindrical wall, and a tapered surface contiguous to and located on a tangential line of the bowllike surface for caulking the free end of the cylindrical wall.

4. A method as set forth in claim 1, wherein a range between the root and a middle portion of the cylindrical wall is caulked by a first punch having a bowllike surface, and the free end of the cylindrical wall is caulked by a second punch having a tapered surface contiguous to and located on a tangential line of the bowllike surface.

5. A method as set forth in claim 1, wherein an inner circumferential surface of the root of the cylindrical wall is spaced from the outer circumferential surface of the spherical portion of the piston rod to define a clearance.

6. A method for linking a piston rod with a disk plate in a compressor wherein the disk plate is operatively driven by a rotor rotatably mounted on a drive shaft for integral rotation therewith, the piston rod being mechanically connected to the disk plate and the piston at opposite ends of the piston rod such that the piston is reciprocally driven in accordance with the rotation of the rotor, said method comprising:

a first process for forming a spherical portion at one end of the piston rod;

a second process for forming a cavity in the disk plate in conformity with the spherical portion of the piston rod;

a third process for forming a cylindrical wall protruding from an opening edge of the cavity, said cylindrical wall having a root and a free end; and a fourth process for caulking the cylindrical wall inwardly for defining an annular clearance having a wedge-like cross section between an inner circumference of the free end of the cylindrical wall and an outer circumference of the spherical portion of the piston rod accommodated in the cavity.

7. A method as set forth in claim 6, wherein said cylindrical wall has a uniform thickness from the root to the free end.

8. A method as set forth in claim 6, wherein the cylindrical wall is caulked by a punch having a bowllike surface for caulking a range between the root and a middle portion of the cylindrical wall, and a tapered surface contiguous to and located on a tangential line of the bowllike surface for caulking the free end of the cylindrical wall.

9. A method as set forth in claim 6, wherein a range between the root and a middle portion of the cylindrical wall is caulked by a first punch having a bowllike surface, and the free end of the cylindrical wall is caulked by a second punch having a tapered surface contiguous to and located on a tangential line of the bowllike surface.

10. A method as set forth in claim 6, wherein an inner circumferential surface of the root of the cylindrical wall is spaced from the outer circumferential surface of the spherical portion of the piston rod to define a clearance.

11. A method for connecting a piston with a disk plate by way of a piston rod in a compressor wherein the disk plate is operatively driven by a rotor rotatably mounted on a drive shaft for integral rotation therewith, the piston rod being mechanically connected to the disk plate and the piston at opposite ends of the piston rod such that the piton is reciprocally driven in accordance with the rotation of the rotor, said method comprising:

a first process for forming a spherical portions at both ends of the piston rod, respectively;

a second process for forming cavities in the disk plate and the piston, said cavities being conformable to the spherical portions of the piston rod, respectively;

a third process for forming a cylindrical wall protruding from an opening edge of each cavity, each of said cylindrical walls having a root, a middle portion, and a free end; and a fourth process for caulking each of the cylindrical walls inwardly for respectively defining annular clearances having wedge-like cross sections between an inner circumference of the free end of each of the associated cylindrical wall and an outer circumference of the spherical portion of the respective ends of the piston rod accommodated in the associated cavities.

12. A method as set forth in claim 11, wherein each of said cylindrical walls has a uniform thickness from the root to the free end.

13. A method as set forth in claim 11, wherein each of the cylindrical walls is caulked by a punch having a bowllike surface for caulking a range between the root and the middle portion of each of the cylindrical walls, and a tapered surface contiguous to and located on a tangential line of the bowllike surface for caulking the free end of each of the cylindrical walls.

14. A method set forth in claim 11, wherein a range between the root and the middle portion of each of the cylindrical walls is caulked by a first punch having a bowllike surface, and the free end of each of the cylindrical walls is caulked by a second punch having a tapered surface contiguous to and located on a tangential line of the bowllike surface.

15. A method as set forth in claim 11, wherein an inner circumferential surface of the root of each of the cylindrical walls is spaced from the outer circumferential surface of the spherical portion of the respective ends of the piston rod to define a clearance.

16. A tool for caulking a cylindrical wall having a root around an outer edge of a cavity, a middle portion and a free end, wherein said cavity accommodates a spherical portion formed at an end of a piston rod, said tool comprising:

a bowllike surface for caulking a range between the root and the middle portion of the cylindrical wall; and a tapered surface contiguous to and placed on a tangential line of the bowllike surface for caulking the free end of the cylindrical wall.

17. A tool as set forth in claim 16, wherein said cylindrical wall has a uniform thickness from the root to the free end.

18. A tool as set forth in claim 16, wherein an inner circumferential surface of the root of the cylindrical wall is spaced from the outer circumferential surface of the spherical portion of the piston rod to define a clearance.

* * * * *